US010755323B2

(12) United States Patent
Kuruvila

(10) Patent No.: US 10,755,323 B2
(45) Date of Patent: Aug. 25, 2020

(54) WIDGET-BASED INTEGRATION OF PAYMENT GATEWAY FUNCTIONALITY INTO TRANSACTIONAL SITES

(71) Applicant: Amazon Technologies, Inc., Seattle, WA (US)

(72) Inventor: Vinay Kuruvila, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 77 days.

(21) Appl. No.: 15/682,375

(22) Filed: Aug. 21, 2017

(65) Prior Publication Data

US 2018/0025397 A1 Jan. 25, 2018

Related U.S. Application Data

(63) Continuation of application No. 12/236,285, filed on Sep. 23, 2008, now Pat. No. 9,747,621.

(51) Int. Cl.
*G06Q 30/04* (2012.01)

(52) U.S. Cl.
CPC ..... *G06Q 30/04* (2013.01)

(58) Field of Classification Search
CPC .... G06Q 20/08; G06Q 20/322; G06Q 20/401; H04L 67/02; H04L 67/20; H04L 69/22; G06F 17/2705; G06F 40/221
See application file for complete search history.

(56) References Cited

U.S. PATENT DOCUMENTS

| | | | |
|---|---|---|---|
| 5,671,279 | A | 9/1997 | Elgamal |
| 5,715,314 | A | 2/1998 | Payne et al. |
| 5,724,424 | A | 3/1998 | Gifford |
| 5,757,917 | A | 5/1998 | Rose et al. |
| 5,815,665 | A | 9/1998 | Teper et al. |
| 5,878,141 | A | 3/1999 | Daly et al. |
| 5,890,137 | A | 3/1999 | Koreeda |
| 5,903,652 | A | 5/1999 | Mital |
| 5,903,721 | A | 5/1999 | Sixtus |
| 5,903,878 | A | 5/1999 | Talati et al. |
| 5,956,483 | A | 9/1999 | Grate et al. |

(Continued)

FOREIGN PATENT DOCUMENTS

| | | |
|---|---|---|
| EP | 0 793 203 A2 | 9/1997 |
| EP | 1 168 264 A2 | 1/2002 |
| WO | WO 01/43033 A1 | 6/2011 |

OTHER PUBLICATIONS

Grehan, Rick, "Diving Deep into Amazon WebServices", Infoworld.conn, San Mateo, Aug. 13, 2008, pp. 1-5 (Year: 2008).*

(Continued)

*Primary Examiner* — Mohammad Z Shaikh

(74) *Attorney, Agent, or Firm* — Knobbe, Martens, Olson & Bear, LLP

(57) ABSTRACT

Various embodiments of a payment service are disclosed. In some embodiments, a merchant can enable customer use of the payment service by adding widget code to a web page, such as a catalog or shopping cart page, of the merchant's site. Thereafter, a user can invoke the payment service and complete a purchase transaction directly from the merchant site, without navigating or being redirected to a separate payment service site. In some embodiments, the user can complete the transaction without having or creating an account with the payment service.

17 Claims, 9 Drawing Sheets

(56) References Cited

U.S. PATENT DOCUMENTS 5,960,411 A 9/1999 Hartman et al.
6,005,939 A 12/1999 Fortenberry et al.
6,021,397 A 2/2000 Jones et al.
6,070,142 A 5/2000 McDonough et al.
6,078,902 A 6/2000 Schenkler
6,092,053 A 7/2000 Boesch et al.
6,092,196 A 7/2000 Reiche
6,275,824 B1 8/2001 O'Flaherty et al.
6,327,578 B1 12/2001 Linehan
6,332,134 B1 12/2001 Foster
6,490,601 B1 * 12/2002 Markus ..... G06F 17/243 705/80
6,516,416 B2 2/2003 Gregg et al.
6,601,761 B1 8/2003 Katis
6,957,334 B1 10/2005 Goldstein et al.
6,970,852 B1 11/2005 Sendo
7,076,445 B1 7/2006 Cartwright
7,146,341 B1 12/2006 Light et al.
7,155,411 B1 12/2006 Blinn et al.
7,194,437 B1 3/2007 Britto et al.
7,194,679 B1 * 3/2007 Green ..... G06F 40/14 715/233
7,349,867 B2 3/2008 Rollins
7,356,507 B2 * 4/2008 Bezos ..... G06Q 20/00 705/40
7,457,778 B2 * 11/2008 Li ..... G06Q 30/0641 705/39
7,499,889 B2 3/2009 Golan et al.
7,502,760 B1 3/2009 Gupta
7,536,351 B2 * 5/2009 Leblang ..... G06Q 20/00 705/40
7,658,324 B2 2/2010 Gindele
7,685,067 B1 3/2010 Britto et al.
7,877,299 B2 1/2011 Bui
7,966,259 B1 6/2011 Bui
7,975,019 B1 7/2011 Green et al.
7,975,020 B1 7/2011 Green et al.
8,160,935 B2 4/2012 Bui
8,271,878 B2 * 9/2012 Kane ..... G06Q 30/02 715/733
8,355,959 B2 1/2013 Bui
8,370,749 B2 * 2/2013 Morse ..... G06Q 20/02 715/738
8,374,958 B2 * 2/2013 Blott ..... G06Q 30/06 382/100
8,423,420 B1 4/2013 Bhosle et al.
8,533,054 B1 9/2013 Haney
8,595,186 B1 * 11/2013 Mandyam ..... G06F 8/38 707/632
8,626,665 B2 1/2014 Bui
8,689,099 B1 4/2014 Hanni et al.
8,689,124 B2 4/2014 Amacker
8,713,418 B2 4/2014 King et al.
8,996,408 B1 3/2015 Carver et al.
9,234,098 B2 * 1/2016 Konig ..... B82Y 30/00
9,324,098 B1 * 4/2016 Agrawal ..... G06Q 30/04
9,747,621 B1 * 8/2017 Kuruvila ..... G06Q 30/04
9,754,245 B1 * 9/2017 Davison ..... G06Q 20/12
10,528,931 B1 * 1/2020 Agrawal ..... G06Q 20/363
2001/0042785 A1 11/2001 Walker et al.
2001/0044787 A1 11/2001 Swartz et al.
2002/0072980 A1 6/2002 Dutta
2002/0112171 A1 8/2002 Ginter et al.
2002/0120567 A1 * 8/2002 Caplan ..... G07F 17/0014 705/40
2002/0144119 A1 10/2002 Benantar
2003/0014317 A1 * 1/2003 Siegel ..... G06Q 10/087 705/22
2003/0014519 A1 1/2003 Bowers et al.
2003/0164859 A1 * 9/2003 Evans ..... G06F 3/0481 715/792
2003/0236711 A1 12/2003 Deguchi
2004/0024846 A1 * 2/2004 Randall ..... H04L 67/26 709/219
2004/0025056 A1 2/2004 Katsube
2004/0030615 A1 2/2004 Ling
2004/0117302 A1 6/2004 Weichert et al.
2004/0148232 A1 7/2004 Fushimi et al.
2004/0235450 A1 11/2004 Rosenberg
2005/0091111 A1 4/2005 Green et al.
2005/0193368 A1 * 9/2005 Becker ..... G06F 9/451 717/106
2005/0210270 A1 9/2005 Rohatgi et al.
2005/0216421 A1 9/2005 Barry et al.
2006/0064380 A1 3/2006 Zukerman
2006/0168536 A1 * 7/2006 Portmann ..... G06F 9/451 715/762
2006/0218052 A1 9/2006 Haynes et al.
2006/0218630 A1 9/2006 Pearson et al.
2006/0229884 A1 10/2006 Grundhoff et al.
2006/0229998 A1 10/2006 Harrison et al.
2007/0027696 A1 2/2007 Burger
2007/0050307 A1 3/2007 Light et al.
2007/0061328 A1 3/2007 Ramer et al.
2007/0078963 A1 * 4/2007 Woodard ..... G06F 16/958 709/223
2007/0180508 A1 8/2007 Thomson
2007/0186106 A1 8/2007 Ting et al.
2007/0199053 A1 8/2007 Sandhu et al.
2007/0203850 A1 8/2007 Singh et al.
2007/0244811 A1 10/2007 Tumminaro
2007/0245022 A1 10/2007 Olliphant et al.
2007/0255653 A1 11/2007 Tumminaro et al.
2007/0271192 A1 11/2007 Brunet et al.
2007/0299732 A1 12/2007 Gluzberg et al.
2008/0010112 A1 * 1/2008 Kniaz ..... G06Q 30/02 705/14.14
2008/0010298 A1 1/2008 Steele et al.
2008/0033879 A1 2/2008 Blinn et al.
2008/0040681 A1 * 2/2008 Synstelien ..... G06F 9/451 715/765
2008/0071725 A1 3/2008 Raskin et al.
2008/0097842 A1 4/2008 Tirumala et al.
2008/0097843 A1 4/2008 Menon et al.
2008/0097871 A1 * 4/2008 Williams ..... G06Q 20/10 705/500
2008/0097906 A1 * 4/2008 Williams ..... G06Q 20/10 705/44
2008/0098289 A1 * 4/2008 Williams ..... G06F 9/451 715/200
2008/0098290 A1 * 4/2008 Williams ..... G06F 21/51 715/209
2008/0098325 A1 4/2008 Williams et al.
2008/0104496 A1 5/2008 Williams et al.
2008/0126145 A1 5/2008 Rackley, III et al.
2008/0183593 A1 * 7/2008 Dierks ..... G06Q 20/102 705/26.35
2008/0189186 A1 8/2008 Choi et al.
2008/0235123 A1 * 9/2008 Olliphant ..... G06Q 20/12 705/35
2008/0270417 A1 10/2008 Roker
2008/0270909 A1 10/2008 Kaufman et al.
2008/0288405 A1 11/2008 John
2008/0306838 A1 * 12/2008 Fleet ..... G06Q 30/0603 705/26.81
2008/0307034 A1 * 12/2008 Fleet ..... G06Q 30/0603 709/202
2008/0319869 A1 12/2008 Carlson
2008/0319914 A1 12/2008 Carrot
2009/0144066 A1 * 6/2009 Van Luchene ..... G06Q 10/067 705/348
2009/0150262 A1 * 6/2009 Mizhen ..... G06Q 20/12 705/26.1
2009/0198581 A1 * 8/2009 Lidestri ..... G06Q 30/00 705/14.14
2009/0216683 A1 8/2009 Gutierrez
2009/0240597 A1 9/2009 Oswald
2009/0249359 A1 * 10/2009 Caunter ..... G06F 9/454 719/315
2009/0265257 A1 10/2009 Klinger et al.
2009/0271250 A1 10/2009 Sriver et al.
2009/0271289 A1 10/2009 Klinger et al.

(56) References Cited

U.S. PATENT DOCUMENTS

| | | | | |
|---|---|---|---|---|
| 2009/0281944 | A1 | 11/2009 | Shakkarwar | |
| 2009/0287581 | A1 | 11/2009 | Sriver et al. | |
| 2009/0292927 | A1 | 11/2009 | Wenzel et al. | |
| 2010/0010902 | A1 | 1/2010 | Casey | |
| 2010/0042487 | A1* | 2/2010 | Barazani | G06Q 30/02 705/14.13 |
| 2010/0042931 | A1 | 2/2010 | Dixon et al. | |
| 2010/0057552 | A1 | 3/2010 | O'Leary et al. | |
| 2010/0114739 | A1 | 5/2010 | Johnston | |
| 2010/0246827 | A1 | 9/2010 | Lauter et al. | |
| 2010/0250382 | A1* | 9/2010 | Babaria | G06Q 10/087 705/26.1 |
| 2010/0262544 | A1 | 10/2010 | Levchin et al. | |
| 2011/0022484 | A1 | 1/2011 | Smith et al. | |
| 2011/0087530 | A1 | 4/2011 | Fordyce | |
| 2011/0184863 | A1 | 7/2011 | Coleman et al. | |
| 2011/0191173 | A1 | 8/2011 | Blackhurst et al. | |
| 2011/0270909 | A1 | 11/2011 | Fu | |
| 2011/0277016 | A1 | 11/2011 | Hockings et al. | |
| 2011/0302412 | A1 | 12/2011 | Deng et al. | |
| 2012/0054625 | A1 | 3/2012 | Pugh et al. | |
| 2012/0066090 | A1 | 3/2012 | Gangapurkar | |
| 2012/0089481 | A1 | 4/2012 | Iozzia | |
| 2012/0096534 | A1 | 4/2012 | Boulos et al. | |
| 2012/0136754 | A1 | 5/2012 | Underwood | |
| 2012/0159635 | A1 | 6/2012 | He et al. | |
| 2012/0191567 | A1 | 7/2012 | Williams et al. | |
| 2012/0239531 | A1 | 9/2012 | McCann | |
| 2012/0253989 | A1 | 10/2012 | Otruba et al. | |
| 2012/0254720 | A1 | 10/2012 | Hamm et al. | |
| 2012/0278151 | A1 | 11/2012 | Galit | |
| 2013/0046628 | A1 | 2/2013 | Bennett et al. | |
| 2013/0179345 | A1 | 7/2013 | Bui | |
| 2013/0290127 | A1 | 10/2013 | Finseth | |

OTHER PUBLICATIONS

Rofrano, J.J., "IBM Webshpere Suite Product Advisor", IBM Systems Journal, vol. 40, No. 1, pp. 91-103 (Year: 2001).*
Adabala, et al., "Single Sign-On in In-Vigo: Role-based Access via Delegation Mechanisms Using Short-lived User Identities", Proceedings of the 18th International Parallel and Distributed Processing Symposium (IPDPS'04), IEEE, 2004, 8 pages.
U.S. Appl. No. 12/265,523, filed Nov. 5, 2008, Agrawal, et al.
Amazon.com, About 1-click and Gift-Click Ordering, Printed from www. amazon.com on Dec. 9, 1999.
Borenstein et al., "Perils and Pitfalls of Practical Cybercommerce," Jun. 1996, pp. 36-44, vol. 39, No. 6.
Cox et al., "NetBill Security and Transation Protocol," Proceedings of the First USENIX Workshop on Electronic Commerce, Jul. 1995.
"Cybercash Unveils "Instabuy.com" Web Site for Consumer One-Click Shopping Online," InstaBuy Press Release, Feb. 22, 1999, Printed from www.instabuy.com on Sep. 2, 1999.
Digital Wallets Project Home Page: http://www.db.stanford.edu/~daswani/wallets/, printed on Sep. 2, 1999.
Foster, Chuck; U.S. Appl. No. 60/162,651, filed Nov. 1, 1999.
Guglielmo, "A Tale of Two One-Click Initiatives," Printed from www.zdnet.com on Sep. 2, 1999.
"HTML." Microsoft Computer Dictionary, 5th Ed. 2002, p. 258-259 (4 pages).
"The InstaBuy™ Consumer Experience," PDF document downloaded from www.instabuy.com on Sep. 2, 1999.
"InstaBuy℠ From Cybercash Offers Easy and Safe Buying Solution to Online Consumers and Merchants," InstaBuy Press Release Aug. 19, 1998, Printed from www.instabuy.com on Sep. 2, 1999.
InstaBuy Merchant FAQ, Printout of web page http://www.instabuy.com/merchants/merch_faq.html, instabuy.com, 1999, pp. 1-4.
Kong, "Sharing Your Data Can Get You Discounts," Printed from San Jose Mercury News web site on Oct. 11, 1999.
Protocol of Discover, "Create Secure Online Account Numbers", obtained from http://www.discovercard.ca/customer-service/faq/soan.html on Oct. 17, 2011, 13 pages.
Qiang, et al., "The design and implementation of standards-based Grid single sign-on using federated identity", 12th IEEE International Conference on High Performance Computing and Communications, IEEE, 2010, pp. 458-464.
Smith, Ph.D., "Virtual Credit Cards Offer Safer Online Holiday Shopping", Credict Card Guide of Orbiscom, Jan. 2010, accessible from http://www.orbiscom.com/news143.html, 1 page.
"Understanding InstaBuy. A Consumer and Merchant Overview," PDF document downloaded from www.instabuy.com on Sep. 2, 1999.
Walker, "Digital Wallets," Printed from www.computerworld.com/home/features.nsf/all/990705qs on Sep. 2, 1999.
IMEI Third Generation Partnership; Technical Specification Group Services and System Aspects; International Mobile Station Equipment Identities, 2009.
U.S. Appl. No. 14/135,134, Payment Service Capable of Being Integrated With Merchant Sites, filed Dec. 19, 2013.
U.S. Appl. No. 12/265,523, Hosted Payment Service System and Method, filed Nov. 5, 2008.
U.S. Appl. No. 15/078,958, Hosted Payment Service System and Method, filed Mar. 23, 2016.
U.S. Appl. No. 12/847,515, Multi-Source Content Distribution With Authentication, filed Jul. 30, 2010.
U.S. Appl. No. 13/094,774, In-Line Payment Processing From Interactive Applications, filed Apr. 26, 2011.
U.S. Appl. No. 13/098,160, Transaction Processing and Support for Physical-Presence Merchants, filed Apr. 29, 2011.

* cited by examiner

WIDGET-BASED INTEGRATION OF PAYMENT GATEWAY FUNCTIONALITY INTO TRANSACTIONAL SITES

BACKGROUND

Description of the Related Technology

Consumers routinely shop for and purchase products and services from merchant web sites and other types of interactive systems. For some merchant sites, the customer can add one or more items to an electronic shopping cart and then enter a checkout pipeline of the merchant's site. Some merchant sites also allow customers to purchase individual items without the use of a shopping cart. During the checkout process, the customer commonly specifies credit card and shipping information for completing the transaction. The merchant's system then uses the specified information to complete the payment transaction.

Some merchant sites allow or require customers to complete the checkout process using a payment service hosted by a third party payment service provider. Typically the payment service provides the merchant with detailed programming instructions on how to integrate the merchant's checkout process with the payment service. For example, a payment service may provide the merchant with application programming interfaces which the merchant uses to configure the merchant site to interact with the payment service.

When the customer opts to use such a payment service, the merchant site commonly directs or redirects the user's browser to a separate web site operated by the payment service provider. Payment providers typically direct the customer to log into an existing account with the payment service provider or, alternatively, create a new account. After completing the transaction on the payment service provider's site, the customer can return to the merchant's site, if desired. One benefit of such third party payment services is that they reduce or eliminate the need for the merchant to set up and maintain the infrastructure for collecting payments from Internet users. This benefit can be especially significant for small merchants that do not have the resources needed to set up payment processing systems. Another benefit is that consumers can use a single account with a single entity to make purchases from many different merchants and merchant sites. Thus, consumers need not set up accounts with, or disclose his or her payment information to, all of the merchants from which they make purchases.

BRIEF DESCRIPTION OF THE DRAWINGS

Specific embodiments will now be described with reference to the drawings, which are intended to illustrate and not limit the various features described herein.

DETAILED DESCRIPTION OF SPECIFIC EMBODIMENTS

Various embodiments of a payment gateway service (hereinafter "payment service") are disclosed. In some embodiments, a merchant can enable customer use of the payment service by adding a line or sequence of widget code to a web page, such as a shopping page, of the merchant's site. Thereafter, a user can invoke the payment service and complete a purchase transaction directly from the merchant site, without navigating or being redirected to a separate payment service site, and without the need to have or create an account with either the payment service or the merchant site.

For example, while viewing the merchant shopping page, the user may be able to securely interact with the payment service and complete the purchase transaction via a payment form that is displayed on a shopping page of the merchant site. The payment form may include one or more controls (e.g., buttons) and an electronic form for receiving information related to the purchase transaction are incorporated into the shopping page of the merchant. The display of the gateway module may be enabled by the widget code added to the page by the merchant. Widget code may additionally or alternatively be added to other types of pages of the merchant site, such as product detail pages, to enable transactions to be completed from such pages.

Several different computer-implemented processes will now be described for providing a payment service. These processes may be embodied individually or in any combination in a computer system or network of computer systems that implements a payment service.

Figure 1:
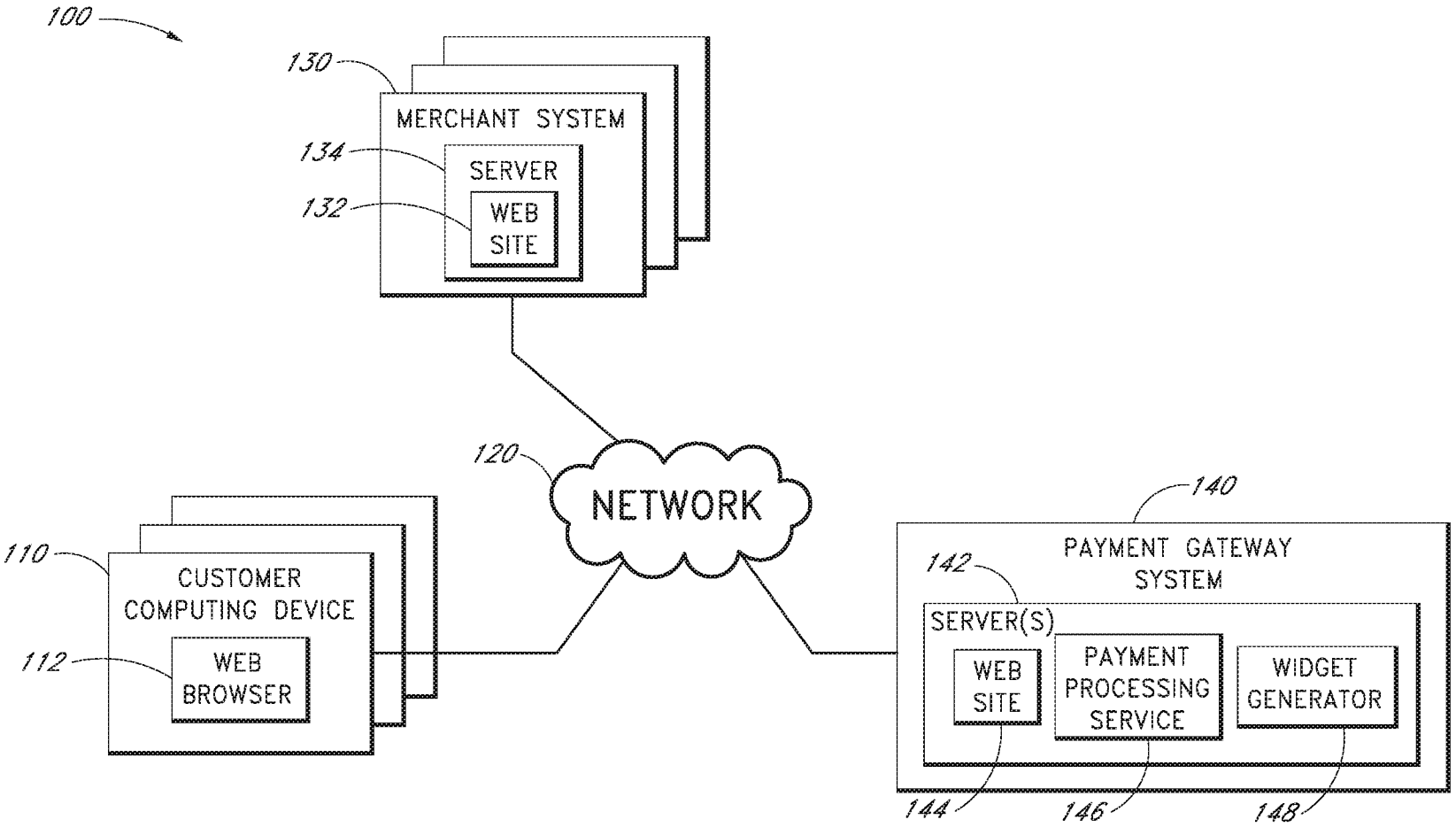
FIG. 1 illustrates a payment gateway service system that can be invoked to complete purchase transactions from merchant sites according to one embodiment of the invention.

FIG. 1 illustrates a payment service system 140 that can be invoked to complete purchase transactions from merchant sites according to one embodiment. The payment service system 140, a customer computer device 110, a merchant system 130, and a customer computing device 110 are interconnected by a network 120 according to one embodiment. The network 120 can be the Internet and/or some other communications network, for example. The customer can be any entity or individual interested in purchasing products or services from the merchant. The terms "customer" and "user" are used interchangeably herein, and are not to be interpreted as limiting.

The merchant can be any individual or entity that sells products or services via a merchant web site 132, which can be implemented on a server system that includes one or more physical servers 134, such as, for example, web servers. The customer selects and purchases products or services (generally referred to as "items") using a web browser 112 running on the computing device 110. As illustrated by FIG. 1, there may be more than one customer and associated customer computing device 110 and more than one merchant and associated merchant system 130. As will be apparent, the merchant system 130 need not itself include any components or functionality for dynamically generating web pages, recognizing users, managing user accounts, or processing payments. For example, the merchant system 130 can consist of a web server that merely hosts static HTML (Hypertext Markup Language) based web documents. As discussed below, the merchant system 130 may, but need not, be capable of implementing electronic shopping carts.

The payment service system 140 may be implemented as a computer system that includes one or more physical servers 142 and/or other computer hardware resources. In various embodiments, the servers 142 can include servers that are co-located and/or geographically distributed. A web site 144 hosted on one or more web servers of the payment service 140 allows the merchant to set up and manage an account with the payment service. After setting up an account, the payment service system 140 allows the merchant to enable the payment service on the merchant web site 132. As described in greater detail herein, a widget generator 148 runs on one or more of the servers 142 of the payment service 140 and generates widget code in response to a request from a merchant. The merchant can then embed the widget code in one or more pages (e.g., HTML documents) of the merchant web site in order to enable use of the payment service 140.

A payment processing web service 146 can run on one or more of the servers 142 and is called to process payments on behalf of the merchant in response to a request from the customer. For example, the customer generates the request by browsing to a shopping page of the merchant site 132 and initiating a purchase transaction for one or more items on the shopping page. The payment service 140 processes payments from customers associated with purchases from merchants in an efficient and user friendly manner. For example, the payment service 140 can process payments from the customer without having to re-direct the customer from the web site 132 of the merchant to a web site of the payment service, and without requiring the customer to have or create and account with the payment service or the merchant site. As discussed below, all of the customer interactions with the payment service may occur on a single shopping page of the merchant site (e.g., a product detail page or other catalog page), and such that only a portion of the shopping page is refreshed.

During this process, the existence of the external payment service need not be exposed to the customer. Thus, from the perspective of the customer, the transaction may appear to be processed solely by the merchant site 132. However, in some scenarios (e.g., where merchant is relatively small and the payment service provider is a relatively large and well known), the merchant may wish to expose its use of the external payment service 140 on the merchant site.

Although described with respect to the embodiment of FIG. 1, those of skill in the art will recognize a variety of alternative configurations. For example, in certain embodiments, the payment service 140 communicates with the merchant 130 over a network that is separate from the network used between the merchant 130 and the customer computing device 112. The computing device 112 could generally be any computing device and does not need to be owned by the customer.

Figure 2A:
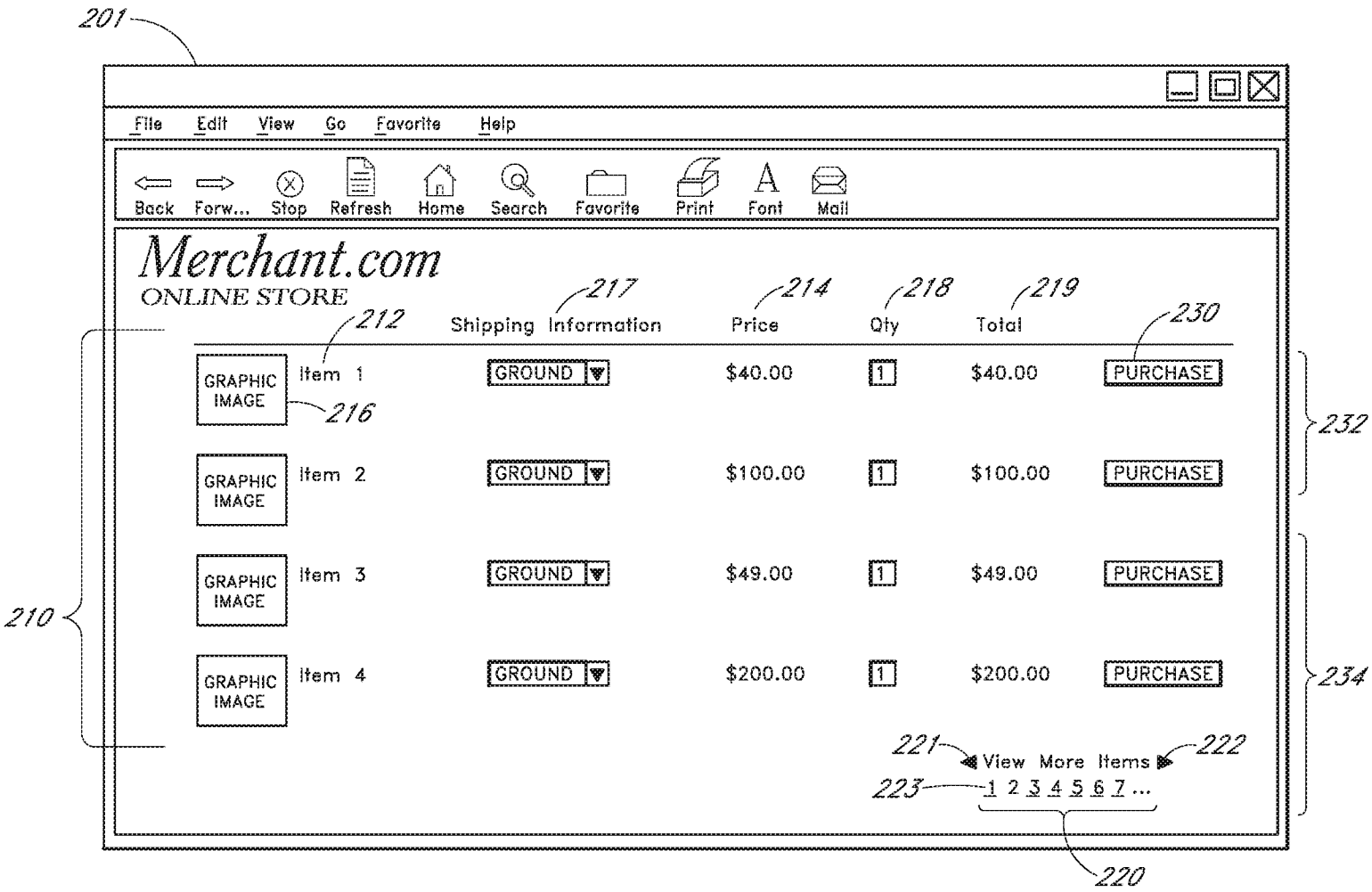
FIGS. 2A-F illustrate pages showing some of the ways payment transactions can be completed using the payment gateway service.

FIGS. 2A-F illustrate pages 201-205 showing some of the ways payment transactions can be completed using the payment service 140. FIG. 2A illustrates a catalog page 201 of an example (hypothetical) merchant web site 132, Merchant.com. The catalog page displays various icons and information associated with items that are available for purchase, including the name 212 of each item, the price 214 associated with each item, a graphical image 216 of each item, a user selectable shipping type 217 (e.g., ground or air) and a user-fillable quantity field 218. Various control features may also be included on the page. For example, the "View More Items" control area 220 allows a user to view other pages on the merchant web site which include other items for sale by the merchant. In the illustrated embodiment, the user is on page two of seven of merchant's electronic catalog. The user can navigate to any page by clicking on one of the corresponding links 223. Different mechanisms may be used to navigate between shopping pages of the merchant web site. All of the page content depicted in FIG. 2A may be served by the merchant system 130.

A checkout button associated with each of the items 210, such as the checkout button 230 associated with Item 1, allows the user to invoke the payment service 140 from the merchant web site 132 to purchase the item associated with the checkout button. When the user selects the checkout button 230, the catalog page, as loaded by the user's browser 112, is updated to create the display 202 of FIG. 2B. As discussed below, the page update depicted in FIG. 2B, and the other updates made during the checkout process (see FIGS. 2C and 2D), occur as the result of widget code added by the merchant to the coding of the catalog page 201, and as the result of browser requests made to the payment service 140 as the result of such widget code.

Figure 2B:
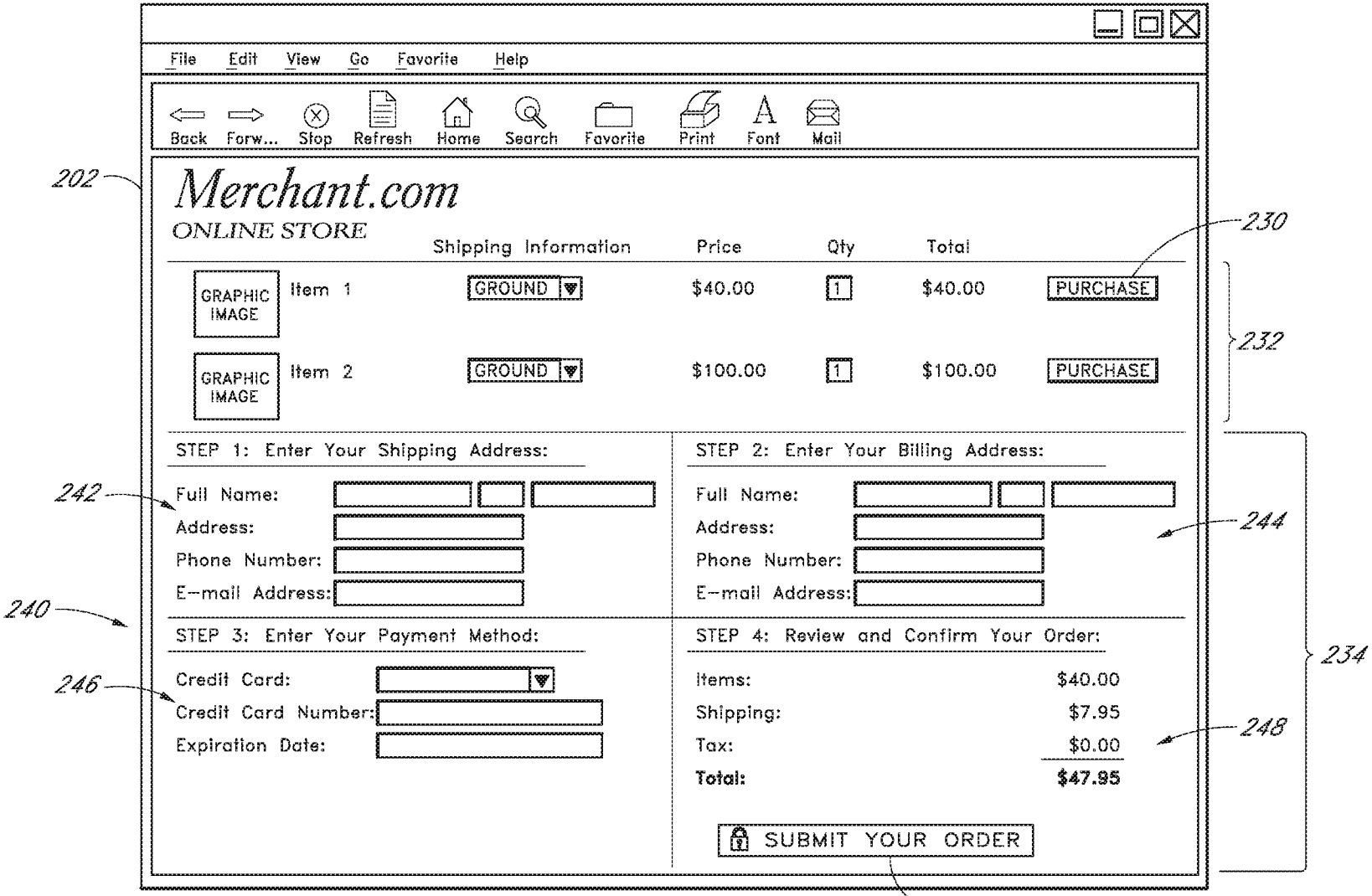

Referring now to FIG. 2B, a user-fillable payment form 240 is displayed to the user along with a confirmation button 250. The payment form 240 is configured to receive payment information from the user such as shipping information 242, billing address information 244 and payment instrument information 246, such as credit card information (e.g., credit card type, credit card number, etc.). The confirmation button 250 (labeled "Submit Your Order") allows the user to complete the purchase transaction for one or more items of the merchant. Although the illustrated embodiment shows credit card payment as the only type of available payment instrument, other types of payment instruments (e.g., bank routing numbers, debit cards, etc.) may be accepted in other configurations.

Figure 2C:
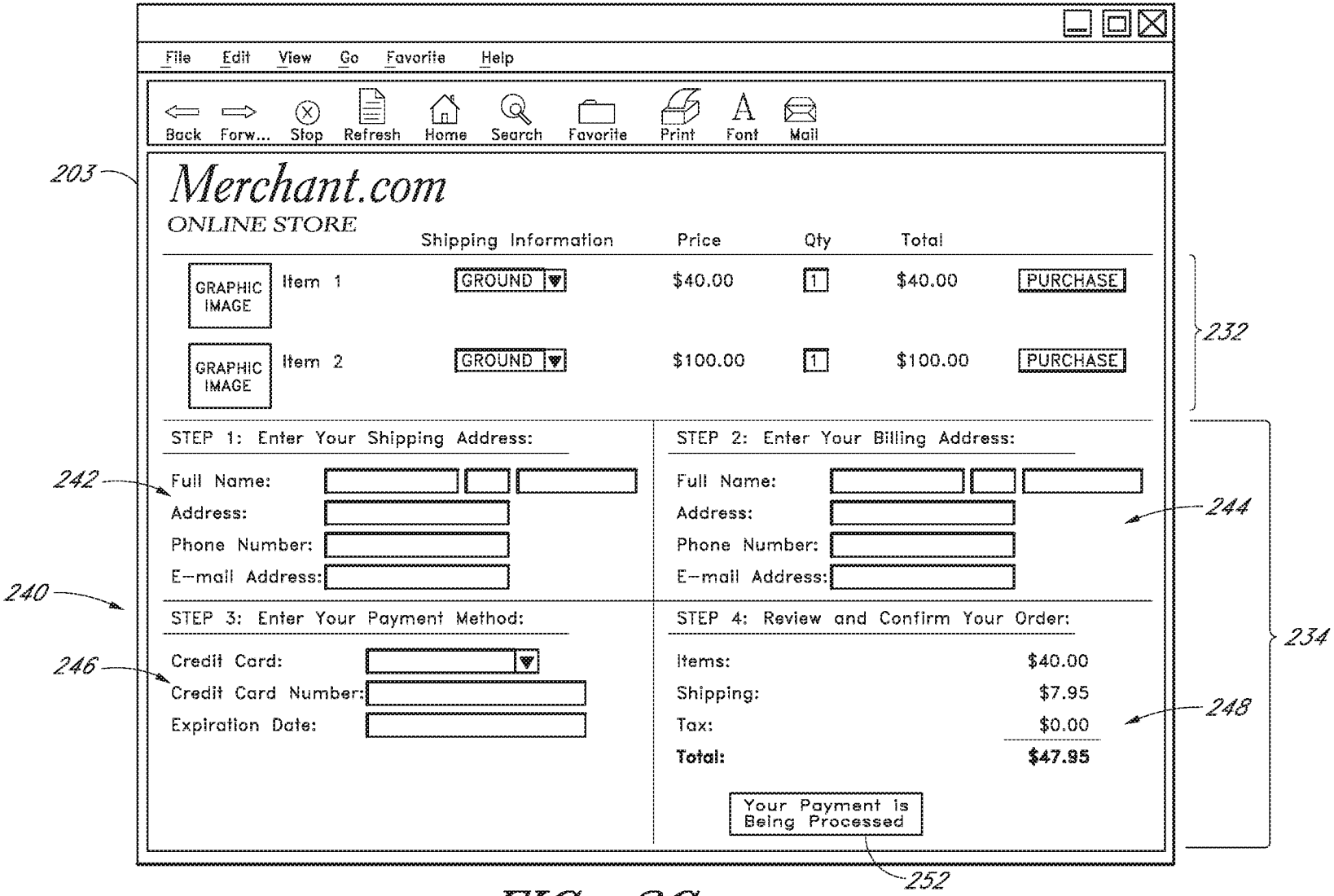

Once the user clicks on the confirmation button 250 in the illustrated embodiment, the catalog page is again updated on the user computing device 110 to create the display 203 of FIG. 2C. The page 203 of FIG. 2C is substantially similar to the page 202 of FIG. 2B except that the confirmation button 250 is replaced with a status message 252 (e.g., "Your payment is being processed . . . "). When the user clicks on the confirmation button 250 of FIG. 2B, the payment service 140 receives a request from the user computing device 110 that includes the payment information as entered into the payment form 250. As will be described in greater detail herein with respect to FIG. 4, a payment processing service 146 of the payment service 140 is called in response to this request and processes the payment from the user on behalf of the merchant. The payment processing service 146 can, for example, receive the payment information input by the user into the form 240 and process the information to cause payment to be collected from the user on behalf of the merchant. The transaction may be processed such that the user's payment information is never exposed to the merchant.

Figure 2D:
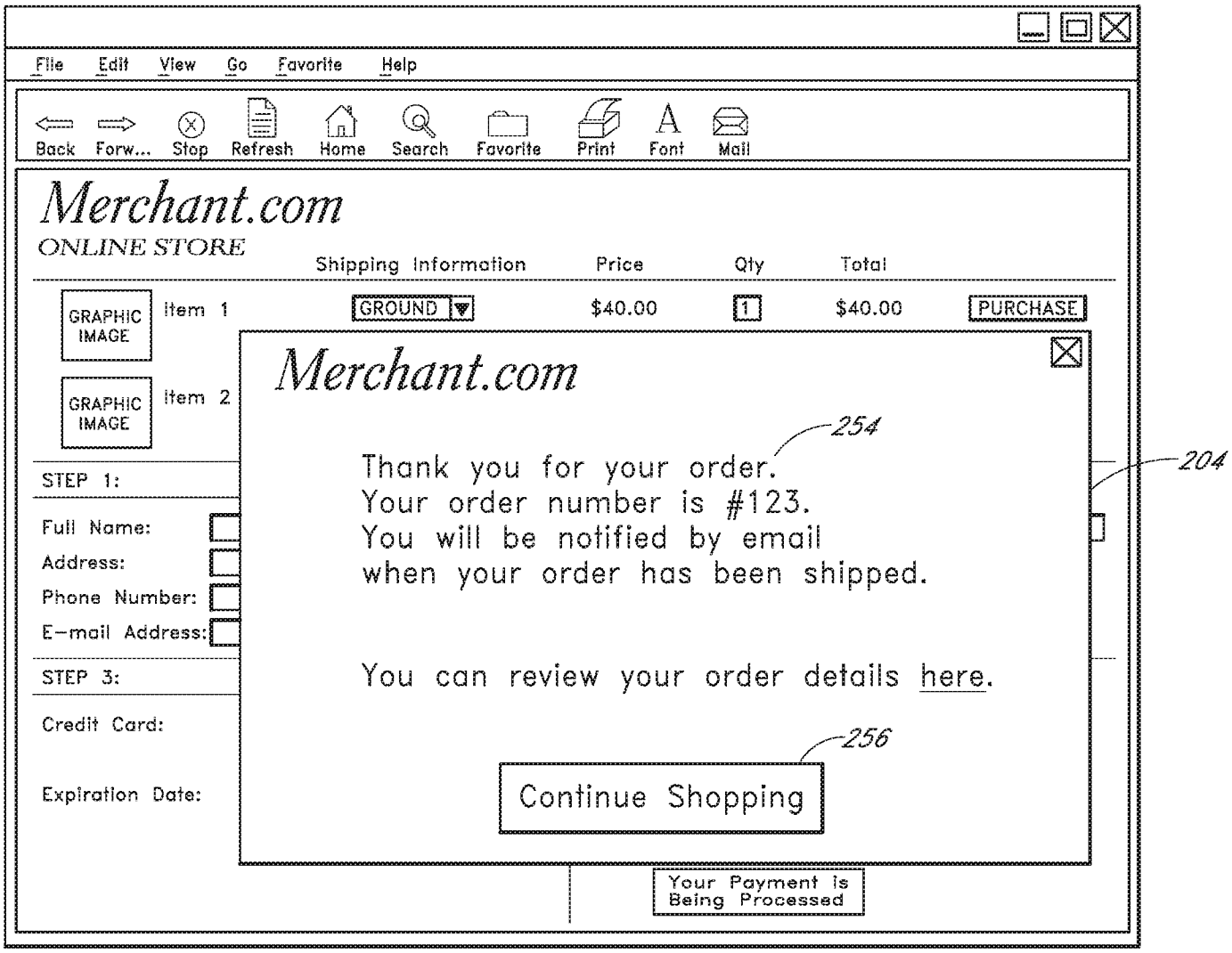

Once the payment is processed, an order confirmation page or object 204 of the type shown in FIG. 2D may be presented. In this example, the confirmation page includes a confirmation or thank you message 254 with an order number. A continue shopping button 256 allows the user to return to the merchant's electronic catalog. In certain embodiments, the confirmation message is at least partially displayed within an overlay display object, which may also be referred to as a "web pop-over." The overlay allows the confirmation message 254 of the payment service to be displayed within the merchant web page without interfering with or displacing the layout of the merchant web page. In this manner, the confirmation message 254 does not have to be incorporated into the layout of the merchant web site, but is still viewable to the user and the user does not have to be redirected to another web page or site. For these and other reasons, using the overlay display object can help the merchant maintain a fluid design flow and user experience while decreasing cost and complexity. The overlay display object becomes part of the merchant web page, and is therefore displayed without opening a new browser window. This is in contrast to pop-up windows, which are displayed in a separate browser window and are not part of the original web page. This characteristic of the overlay display object provides a better user experience, and also avoids the effect of pop-up blockers. In some embodiments, other portions of the payment service are implemented using web pop-overs. For example, the status message 252 may be presented to the user via a web pop-over rather than in the manner shown in FIG. 2C. In other embodiments, other types of display mechanisms may be used, such as, for example, web pop-ups.

The portions of the merchant web site that enable the payment service, such as the checkout buttons 230, the payment form 240, the confirmation button 250, the status message 252 and the confirmation message 254 are referred to herein as a widget and can be defined by widget coding that is embedded in the web page coding of the shopping page. The customer can then browse to a web page of the merchant using the browser 112 and cause the payment processing service 146 to be called by electing to purchase one or more items on the merchant web page (e.g., by clicking the confirmation button 250) which processes a payment from the user on behalf of the merchant. The widget may be generated by widget code, such as JavaScript code, that is downloaded and executed by the web browser 112 of the customer. The widget code may alternatively be written in a different scripting language, such as DHTML or Adobe Flash.

The user interface depicted in the drawings may be varied in numerous ways. For example, in certain embodiments, the status message 252 is not displayed or is displayed in a separate window. As another example, the user's browser 112 may be redirected to another web page of the merchant site 132, or to an external page, upon completion of the transaction. The control mechanisms associated with the shopping page may also be varied. For example, a radio button menu may be used instead of the drop-down menu 217 to change the shipping method, or the shipping method may be selected via the form 240 that appears upon selection of the "purchase" button. Further, the item and transaction information presented may be different from that shown in the drawings.

Figure 2E:
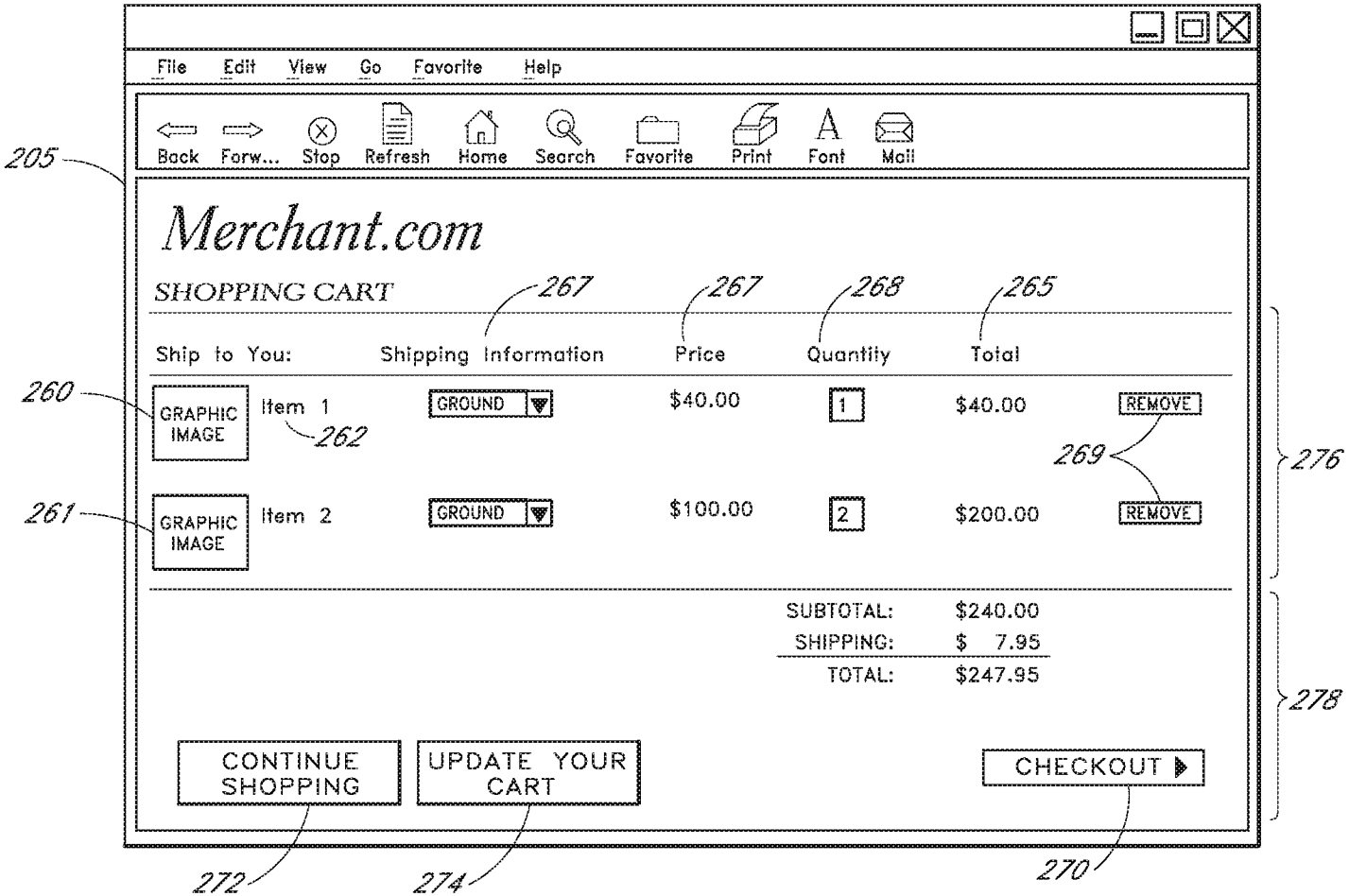

FIG. 2E illustrates an embodiment in which the merchant web site allows or requires the customer to add one or more items to an electronic shopping cart before entering the checkout pipeline of the merchant's site. In this embodiment, the item-specific "purchase" buttons depicted in FIG. 2A may be replaced by, or supplemented with, "add to shopping cart" buttons (not shown). The particular page 205 illustrated in FIG. 2E is a shopping cart page that lists items 260, 261 the user has already added to the shopping cart. The shopping cart page displays the name 262, price 264, and an image 266 of each item, and includes controls 267, 268 for specifying the shipping method and item quantity. The total price for each item, the shopping cart subtotal, and the shopping cart total 265 are also displayed. "Remove" buttons 269 allow the user to remove one or more of the items 260, 261 from the cart. A "continue shopping" button 272 allows the user to return to the catalog page or pages of the merchant's site, and a "cart update" button 274 allows the user to update the cart to reflect changes to the shipping method and/or item quantities. All of the page content depicted in FIG. 2E may be served by the merchant system 130.

Figure 2F:
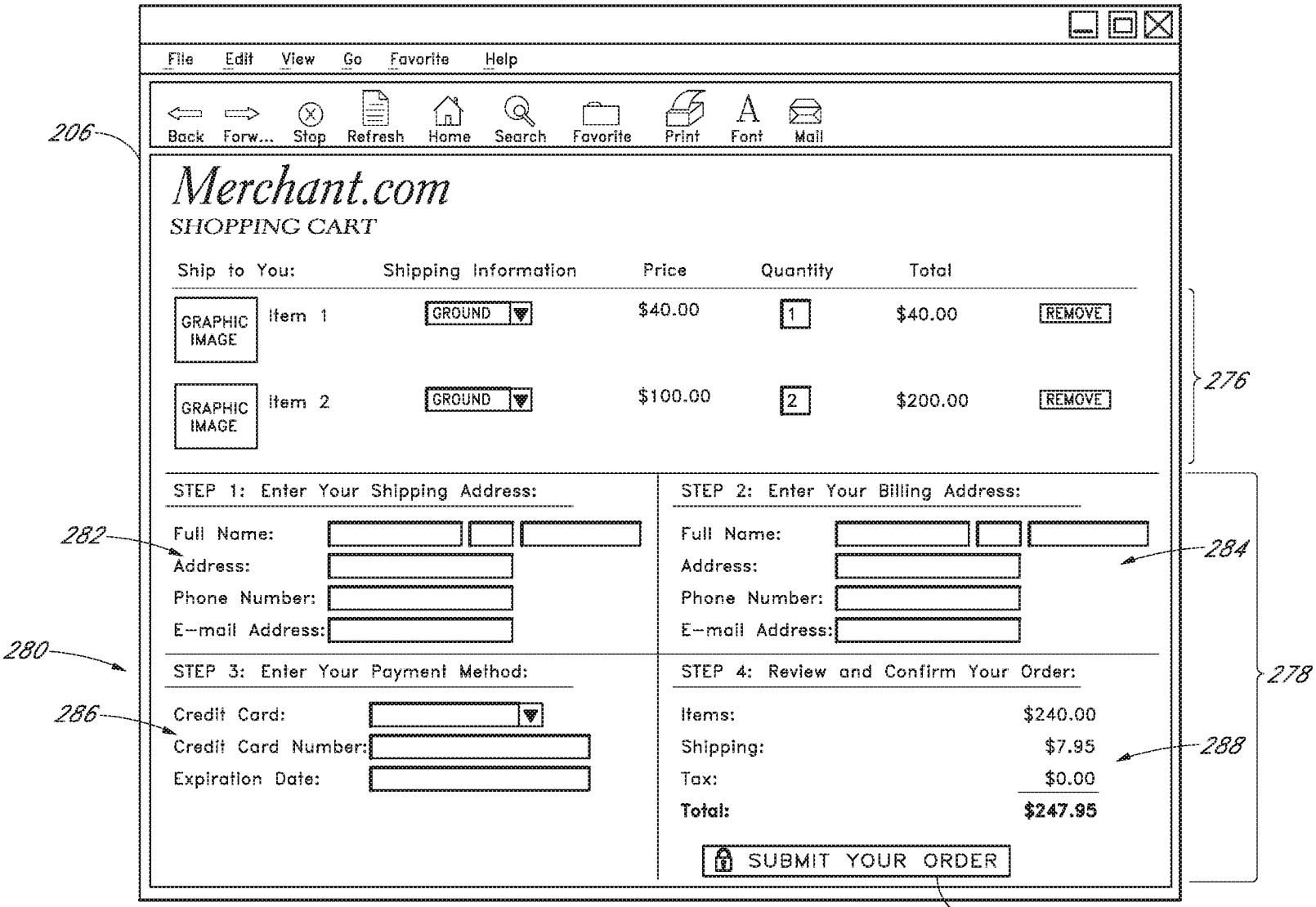

Referring to FIG. 2E, the checkout button 270 can be selected by the user to invoke the payment service 140 from the merchant web site. When the user selects the checkout button 270, the shopping cart page is updated (as the result of browser-execution of embedded widget code, as explained below) as shown in FIG. 2F. From this updated version 206 of the shopping cart page, the user can complete the purchase via substantially the same process as described above with respect to FIGS. 2B-2D. For example, the user fills out payment information in the payment form 280 such as shipping information 282, billing address information 284 and payment instrument information 286. By clicking on the confirmation button 290 (labeled "Submit Your Order"), the user can complete the purchase transaction to purchase the item(s) represented in the shopping cart from the merchant. Once the user clicks on the confirmation button 290, a status message may be presented similar to the status message 252 of FIG. 2C, followed by a confirmation message similar to the confirmation message 254 of FIG. 2D. The widget used in the non-shopping-cart embodiment (FIGS. 2A-2D) is referred to herein as a static gateway widget, and the widget used in the shopping cart embodiment (FIGS. 2E and 2F) is referred to as a dynamic gateway widget. Static and dynamic gateway widgets are be discussed in greater detail below.

Embodiments of the payment service described herein, such as those illustrated with respect to FIGS. 2A-E, process payments from customers associated with purchases from merchants in an efficient and user friendly manner. For example, the payment service can process payments from the customer without having to re-direct the customer's browser from the web site of the merchant to a web site of the payment service or to any other web site in order to complete the purchase transaction. In the illustrated embodiments, for example, the user can complete the transaction using the payment service by interacting with a single web browser window displaying a single web page of the merchant site 132. One reason this feature can be beneficial to merchants and users is that redirection can be jarring for users, negatively affecting the checkout experience and potentially leading to abandoned transactions.

As shown with respect to FIGS. 2A-E, the payment service 140 allows users to complete purchase transactions regardless of whether they have accounts, or are otherwise registered, with the payment service. For example, users who do not have an account do not have to create one in order to use the payment service. (The payment service may, but need not, provide an option for customers to set up accounts.) This feature can be beneficial to merchants and users for several reasons. For example, users may decide to abandon the purchase if they have to create an account with a different entity, such as the payment service. Merchants may also want to give the user a unified branding experience by not making the user feel as though they are dealing with more than one entity. In some configurations, the payment service may provide the customer with the option to log-in to a pre-existing account. In such cases, the payment service may retrieve pre-existing account information in order to process the transaction. For example, in some embodiments, pre-existing billing and/or shipping information of the customer is retrieved by the payment service and the user enters payment instrument information into the payment form. In some configurations, pre-existing payment instrument information associated with the user's account is also retrieved by the payment service.

Another benefit in the illustrated embodiments is that the payment service does not store or retrieve a browser cookie, or other type of authentication object, to/from the user's computing device 110. This aspect of the service can provide benefits to both users and merchants. For example, cookies can become corrupted, and users often disable or delete cookies in their browsers for security or privacy reasons. The ability of the user to use the payment service without a cookie can therefore enhance the general compatibility of the payment service across many different user scenarios. In some embodiments, however, the payment service may use cookies to personalize or enhance the security of the checkout process.

Yet another benefit is that the user need not install any special transaction processing software on their computing devices 110. All that is needed in the illustrated embodiments is a conventional web browser 112.

The payment service described herein and with respect to FIGS. 2A-E allows a user to complete a purchase using the payment service such that only a portion of the shopping page (e.g., catalog page or shopping cart page) is refreshed during the checkout process. For example, referring to FIGS. 2A-C, when the user clicks on the checkout button 230 of FIG. 2A, only a portion 234 of the shopping page is refreshed/updated on the transition from the page 201 of FIG. 2A to the updated page 202 of FIG. 2B, while another portion 232 remains constant. Similarly, when the user clicks on the confirmation button 250 of FIG. 2B, only the area associated with the text of the button 250 is updated to include the status message ("Your payment is being processed . . . ") 252. Because only a portion of the page is refreshed during the different stages of the checkout process, the user experience is relatively seamless; in addition the update can occur in less time than would be required to load a new page. As shown with respect to FIGS. 2E-F, a similar method of refreshing only a portion of the merchant page can be implemented with the illustrated shopping cart page. For example, only a portion 278 of the shopping cart page is updated from the transition from FIG. 2E to FIG. 2F, and the remaining portion 276 remains constant.

The refresh process can differ in various configurations. In one embodiment, the status message 252 is presented to the user on a separate page, similar to the confirmation message 254, which does not include the form 240 in the portion 234 or the description of the items which are on sale in the portion 232. In another embodiment, the confirmation message 254 is also presented to the user with only a partial refresh of the page in a manner similar to the status message 252 of FIG. 2C.

Figure 3A:
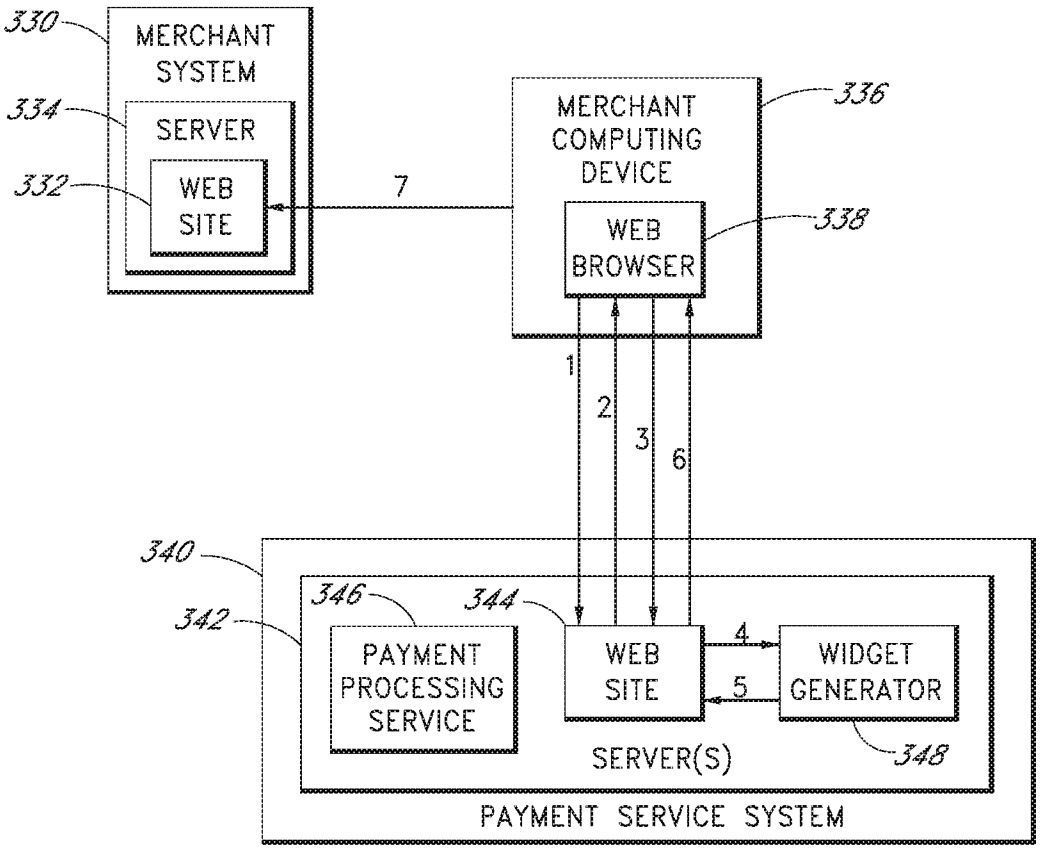
FIG. 3A illustrates a data flow diagram showing the transfer of information between a merchant system, a merchant computing device and a payment gateway service system in accordance with certain embodiments described herein.

FIG. 3A illustrates a data flow diagram 300 showing the transfer of information between a merchant system 330, a merchant computing device 336 and a payment service system 340 in accordance with certain embodiments described herein. The embodiment of the payment service 340 described by the data flow diagram 300 can be the one described above with respect to FIG. 2, for example. Information is sent between the components 330, 336 and 340 over a communications network such as the Internet. The diagram 300 generally shows the steps of automatically generating the payment gateway widget code at a server 342 of the payment service 340, the payment service 340 communicating the code segment to a computing device 336 of the merchant, and the merchant incorporating the widget code into one or more HTML or other documents of the merchant web site 332. The computing device 336 could generally be any computing device and does not need to be co-located with the merchant system 330 or be owned by the merchant. The merchant system 330 and the payment service 340 may be substantially the same in structure and function as the merchant system 130 and the payment service 140 described above with respect to FIG. 1.

The payment service 340 includes a web site 344 which can run on a server system 342 of the payment service 340. The web site allows merchants to register with the payment service, and to request and receive widget code. In this example flow, the merchant is assumed to already be registered with and logged into the payment service site 344. At event 1, the merchant, using a web browser 338 operating on a computing device 336, browses to the web site 344 which causes the browser 338 to request a web page (not shown) that provides functionality for requesting one or more types of widgets. The payment service 340 serves the web page to the web browser 338 of the merchant at event 2 in response to the request.

At event 3, the merchant elects to request a gateway widget for the merchant site. The merchant may elect to request widget code corresponding to a static gateway widget, for example. The merchant is prompted by the payment service 340 to enter information regarding the item the merchant wants to make available using the payment service 340. For example, the merchant may be prompted to enter the price of the item, the description of the item, and whether or not the widget should collect the shipping address of the customer. In some embodiments, other information related to the item, such as a graphical image of the item, is also provided by the merchant. More than one item may be associated with a static gateway widget in some cases such as, for example, where multiple items are sold as a bundle.

The payment service web site 344 receives the merchant-entered information related to the widget and, at event 4, passes the information to a widget generator 348 which may run on a server of the payment service 340. The widget generator 348, for example, may be a software module or function which creates the widget coding based on the information provided by the merchant regarding the item. At event 5, the widget generator passes the widget coding to a page generation module (not shown) of the payment service web site 344, which incorporates the widget code into a web page or other document. This document is then returned to the web browser 338 of the merchant at event 6. The widget coding may alternatively be sent using another communication method, such as e-mail. The widget code segment may be an HTML and/or JavaScript code segment, for example, and may include a unique identifier of the merchant or merchant site.

At event 7, the merchant integrates the widget coding into the appropriate web page coding of the merchant site. By using a static gateway widget, the merchant can obtain the widget coding from the payment service 340 and integrate the payment service with the merchant's web site with little or no programming. For example, in some embodiments the merchant can obtain the widget coding from the payment service 340 and simply cut and paste the widget coding into the appropriate location in an HTML or other document of a catalog page. This relatively straightforward integration by the merchant is particularly useful for merchants who do not have the technical ability (e.g., programming experience) to integrate more complicated functionality into their web sites, such as, for example, by using application programming interfaces. In some embodiments, some of the interactions between the user's computer and the merchant system occur over a secure connection. For example, the portions of the merchant site 332 which include the payment service (e.g., shopping pages of the merchant site 332) are advantageously served using a secure transfer protocol such as HTTPS. Using a secure transfer protocol adds a layer of authentication and security and can help protect the customer's information from being intercepted. In other embodiments, other secure protocols may be used.

In certain cases, merchants may not want to have a "purchase" button for each item or group of items they want to make available to users through the payment service 340. In addition, the merchant may not know what the price will be at the time of purchase by a customer. In these cases, the merchant may elect to create a dynamic gateway widget instead of, or in addition to, a static gateway widget. For example, a widget that includes a shopping cart such as the widget described above with respect to FIGS. 2E-F is a dynamic gateway widget. Referring to FIG. 3A, events 1 and 2 for generating a dynamic gateway widget will be generally similar as to the description above for a static gateway widget. However, at event 3, the merchant will elect to create a dynamic gateway widget and will not be prompted for the item-specific information used in creating the static gateway widget. For example, the merchant will not be prompted for the price of the items or the description of the items at the time of purchase. In one embodiment, the merchant is only prompted to specify whether the payment service 340 is to collect the shipping address of the customer during the checkout process. Events 4, 5 and 6 are generally similar to those described above for the static gateway widget in that the web site 344 passes the information from the merchant to the widget generator 348, which generates the widget coding for the dynamic gateway widget and then passes it back to the web site 344 which returns it to the merchant 338.

At event 7, the merchant integrates (e.g., cuts and pastes) the widget coding for the dynamic gateway widget into the merchant web site. Unlike for the static gateway widget, however, the user may have to perform one or more additional steps in order to implement the dynamic gateway widget. For example, in one embodiment, the merchant may also supply a checkout form (e.g., an HTML form) which includes two hidden fields: a total amount field and a description field. The merchant system can then dynamically populate the values for the total amount and the description into the total amount and description fields, respectively, when the merchant web page including the widget coding is loaded by the customer's browser. The merchant may implement the dynamic population of the fields using an appropriate scripting or programming language such as, for example, Java, PHP, Ruby on Rails, Perl/Mason or C#. The payment service may provide the merchant with instructions on how to implement the dynamic gateway widget including how to create the web form and dynamically populate the fields. Other implementations of the static and dynamic gateway widget are possible. For example, there may be more or less than two dynamically populated fields. The fields can include different information such as, for example, information about other products for purchase related to the products the customer has decided to purchase.

Figure 3B:
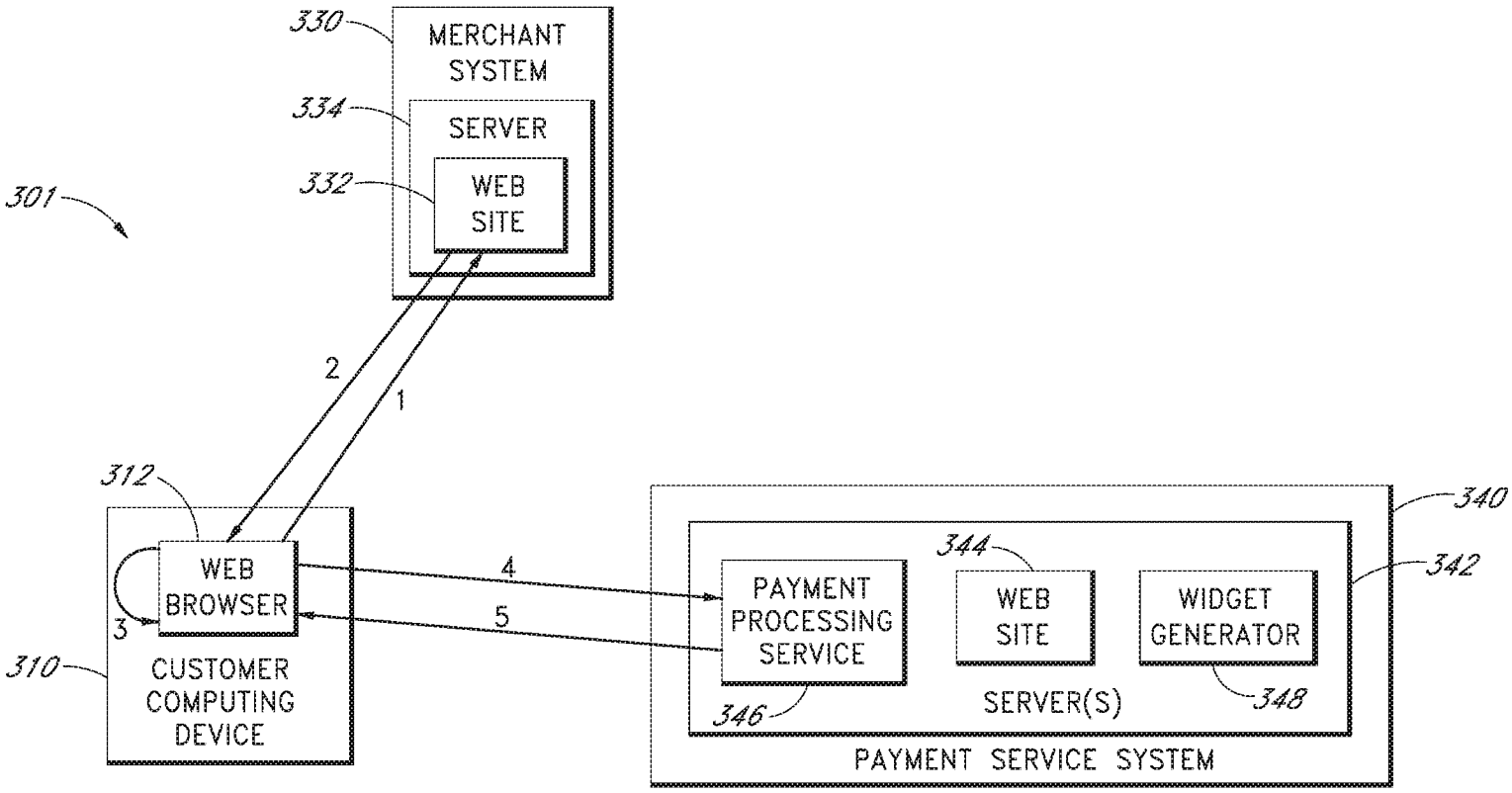
FIG. 3B illustrates a data flow diagram showing the transfer of information between a merchant system, a customer computing device and a payment gateway service system in accordance with certain embodiments described herein.

FIG. 3B illustrates a data flow diagram showing the transfer of information between a merchant system 330, a customer computing device 310 and a payment service system 340 in accordance with certain embodiments described herein. Information is sent between the components 330, 310 and 340 over a communications network such as the Internet. The diagram 301 shows the interactions that occur when the customer requests a catalog or shopping cart page that includes an embedded widget, and then invokes the payment service from this page to complete an associated payment transaction. All of the interactions between the user's browser and the payment service occur as the result of browser-execution of the widget code included in the page.

At events 1 and 2, the customer, using a web browser 312 operating on the computing device 310, causes the browser 312 to request and load a web page of the merchant web site 332. The widget code causes one or more "purchase" buttons (e.g. the checkout button 230 of FIG. 2A) to be displayed. At event 3, the customer elects to purchase an item or items represented on this web page (e.g., using the checkout button 230 of FIG. 2A). The customer may also input the quantity of items they would like to purchase and they may be shown the total price for the order (e.g., as shown with respect to FIG. 2A). In some embodiments, such as described with respect to FIG. 2E, the customer may select an item or items to put in a shopping cart before electing to purchase the items (e.g., using the checkout button 270 of FIG. 2E). The customer will then be presented with a payment form, such as the payment form 240 described above with respect to FIG. 2B, which is configured to receive payment information from the user. The payment form may be included in the original pages as served by the merchant system (in which case it may be maintained hidden unless/until the customer initiates the payment/checkout process), or may be retrieved from the payment service 340 by the browser 312. A confirmation button selectable by the user, such as the "submit your order" button 250 of FIG. 2B, is also displayed on the web page.

At event 4, the customer clicks the confirmation button and a request is received by a server of the payment service 340 in response. The request includes the payment information as entered into the payment form. A payment processing service 346, which may run on a server of the payment service system 340, then processes the information on behalf of the merchant, causing payment to be electronically collected from the user upon successful authentication of the payment information. The payment processing service 346 may collect payment from the user and transfer funds to the merchant by, for example, interacting with credit card processors, banks, and/or other financial institutions using well known methods. In some embodiments, the payment processing service 346 comprises a software module available through an application programming interface which is callable (e.g., via JavaScript) by the customer browser 312 in response to the customer clicking on the confirmation button. As described above, a status message (e.g., "Your payment is being processed . . . ") may be presented to the customer while the payment processing service 346 is processing the payment on behalf of the merchant, and a confirmation message (e.g., "Thank you for your order . . . ") may be presented to the user upon successful completion of the purchase. Upon successful completion of a purchase, the payment service 340 may notify the merchant and/or the customer about the successful completion of the purchase (e.g., via e-mail, voice mail, a data feed, or some other form of communication). In some embodiments, some of the interactions between the user's computer 312 and the payment system 340 occur over a secure connection. For example, the interaction between the user's computer and the payment processing service 346 may be advantageously served using a secure transfer protocol such as HTTPS.

Using a secure transfer protocol adds a layer of authentication and security and can help protect the customer's information from being intercepted. In other embodiments, other secure protocols may be used.

Portions of the widget coding, or coding that is called by the widget coding, may optionally be hosted by a server of the payment service 140, 340. For example, the widget code (e.g., JavaScript) statically incorporated into the page coding by the merchant may, upon execution by the browser, cause the browser to load other JavaScript code from the payment service or from a library file cached by the browser. Thus, the quantity of widget code added by the merchant may be relatively small (e.g., a single line of JavaScript). Alternatively, all of the widget code used during the checkout process may be included in the original shopping page as served by the merchant system. In one embodiment, for example, the payment form is statically embedded in the original page (e.g., in hidden form) and the pop-over which displays the "thank you" message is dynamically retrieved from the payment service via execution of the widget code (e.g., JavaScript).

In certain embodiments, the process in which the code segment is obtained by the merchant may be different and some of the steps may be performed by different entities located in different places. For example, in certain embodiments, the merchant can be given a sample code segment by the payment service 340 which they can modify according to their preference and insert into the web page coding of the merchant page. In some embodiments, the merchant obtains a software program (e.g., from the payment service system) which they can install on a system of the merchant and use to generate the widget code segment.

Those of skill in the art will appreciate from the disclosure herein that alternative configurations are possible. For example, in other configurations the web page coding may include some other scripting language such as dynamic-HTML or Adobe Flash, instead of, or in addition to, JavaScript. In some embodiments, one or more other components instead of, or in addition to, the image file and web page coding are referenced by the document (e.g., an HTML document) which defines the merchant web page.

Part of the data flow operations described with respect to FIGS. 3A-B may be performed by one or more parties not included in the diagram in certain embodiments. For example, a consultant hired by the merchant, or some other entity, may integrate the payment service into the web site of the merchant on behalf of the merchant. In addition, in some embodiments, the payment service does not directly generate and communicate the widget code to the merchant, but instead provides the merchant with a software program which the merchant can use to generate the widget code.

Each of the processes and algorithms described above may be embodied in, and fully automated by, code modules executed by one or more computers or computer processors. The code modules may be stored on any type of computer-readable medium or computer storage device. The processes and algorithms may also be implemented partially or wholly in application-specific circuitry. The results of the disclosed processes and process blocks may be stored, persistently or otherwise, in any type of computer storage.

For purposes of illustration, the processes are described primarily in the context of a system that processes payments for purchase transactions from a web page of a merchant web site. As will be apparent, however, the disclosed processes can also be used in other types of systems, and can be used for other purposes or in other contexts. For example, the disclosed processes can be used to provide third party processing of non-payment related transactions. In certain embodiments, the disclosed processes can be used to authenticate subscribers who are registered with service providers, such as, for example, media service providers. In one embodiment, the disclosed processes can be used to provide processing and authentication of electronic vote tallying or survey information on behalf of another party. Further, the processes may be used to process payments from a web page other than a web page of the merchant from which a purchase is being made. For example, in one embodiment, the processes can be used to allow a user to purchase items from a merchant which are available for purchase (e.g., through advertisements) on another web site, such as a web log (or "blog"). In addition, the disclosed processes can also be implemented in other types of interactive systems that enable users to conduct transactions using documents accessed over a network.

The various features and processes described above may be used independently of one another, or may be combined in various ways. All possible combinations and sub-combinations are intended to fall within the scope of this disclosure. In addition, certain method or process steps may be omitted in some implementations.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Although this disclosure has been described in terms of certain example embodiments and applications, other embodiments and applications that are apparent to those of ordinary skill in the art, including embodiments and applications that do not provide all of the benefits described herein, are also within the scope of this disclosure. The scope of the inventions is defined only by the claims, which are intended to be construed without reference to any definitions that may be explicitly or implicitly included in any of the incorporated-by-reference materials.

What is claimed is:

1. A computer-implemented method implemented by a computing system of a payment service distinct from a merchant system hosting a merchant web page, the computer-implemented method comprising:

generating code that, when parsed by a client device during display of the merchant web page:

causes the client device, without being redirected to a web site of the payment service or otherwise navigating away from the merchant web page, to add one or more input elements to the merchant web page enabling a user to input information related to payment for a transaction and submit the information to the payment service, and allows the user to interact with the payment service directly from the merchant web page to cause the transaction to be executed to completion, and without displaying to the user any indication that the payment is being processed by a party other than a merchant providing the merchant web page;

hosting the code on the payment service at a network location accessible to the client computing device, wherein the merchant web page corresponds to a web document that, when rendered by the client device, instructs the client device to retrieve the code from the network location;

receiving, during display of the merchant web page at the client device and pursuant to the client device implementing instructions of the web document corresponding to the merchant web page, a request from the client device for the code; and responsive to the request from the client device, transmitting the code to the client device, wherein the client device is configured to parse the code during display of the merchant web page, and wherein the code, when parsed by the client device:

causes the client device, without being redirected to the web site of the payment service or otherwise navigating away from the merchant web page, to add one or more input elements to the merchant web page enabling the user to input information related to payment for the transaction and submit the information to the payment service, and allows the user to interact with the payment service directly from the merchant web page to cause the transaction to be executed to completion, and without displaying to the user any indication that the payment is being processed by a party other than the merchant.

2. The method of claim 1, wherein the code corresponds to first code, the method further comprising generating second code for inclusion in the merchant web page, the second code referencing the first code.

3. The method of claim 2 further comprising transmitting the second code to a computing system of the merchant.

4. The method of claim 1, wherein the code comprises at least one of hypertext markup language code or client-side scripting code.

5. The method of claim 1 further comprising generating a secure connection between the computing system and the client device, wherein the code is transmitted to the client device via the secure connection.

6. The method of claim 1 further comprising populating the one or more input elements with information of the user that is stored at the computing system of the payment service.

7. The method of claim 1 further comprising:

receiving the information related to the transaction;

processing the information related to the transaction; and transmitting to a computing system of the merchant an indication that the information related to the transaction has been processed.

8. A system associated with a payment service, the system comprising:

a physical data store associated with one or more server computing devices, the physical data store including code parseable by a client device that, when parsed by the client device during display of a merchant web page:

causes the client device, without being redirected to a web site of the payment service or otherwise navigating away from the merchant web page, to add one or more input elements to the merchant web page enabling a user to input information related to payment for a transaction and submit the information to the payment service, and allows the user to interact with the payment service directly from the merchant web page to cause the transaction to be executed to completion, and without displaying to the user any indication that the payment is being processed by a party other than the merchant; and the one or more server computing devices, wherein the one or more server computing devices are configured with computer-executable instructions to:

host the code on the payment service at a network location accessible to the client computing device, wherein the merchant web page corresponds to a web document that, when rendered by the client device, instructs the client device to retrieve the code from the network location;

receive, during display of merchant web page at the client device and pursuant to the client device implementing instructions of the web document corresponding to the merchant web page, a request from the client device for the code; and responsive to the request from the client device, transmit the code to the client device, wherein the client device is configured to parse the code for parsing during display of the merchant web page, and wherein the code, when parsed by the client device:

causes the client device, without being redirected to the web site of the payment service or otherwise navigating away from the merchant web page, to add one or more input elements to the merchant web page enabling the user to input information related to payment for the transaction and submit the information to the payment service, and allows the user to interact with the payment service directly from the merchant web page to cause the transaction to be executed to completion, and without displaying to the user any indication that the payment is being processed by a party other than the merchant.

9. The system of claim 8, wherein the one or more computing devices are further configured to generate the code.

10. The system of claim 8, wherein the code corresponds to first code, and wherein the physical data further comprises second code for inclusion in the merchant web page, the second code referencing the first code.

11. The system of claim 10, wherein the one or more computing devices are further configured to transmit the code the second code to a computing system of the merchant.

12. The system of claim 8, wherein the one or more computing devices are further configured to populate the one or more input elements with information of the user that is stored at the payment service.

13. The system of claim 8, wherein the one or more computing devices are further configured to:

receive the information related to the transaction;

process the information related to the transaction; and transmit to a computing system of the merchant an indication that the information related to the transaction has been processed.

14. One or more non-transitory computer-readable media comprising:

first code associated with a payment service, wherein the first code includes computer-implementable instructions that, when implemented by a client device during display of a merchant web page cause the client device:

causes the client device, without being redirected to a web site of the payment service or otherwise navigating away from the merchant web page, to add one or more input elements to the merchant web page enabling a user to input information related to payment for a transaction and submit the information to a payment service, and allows the user to interact with the payment service directly from the merchant web page to cause the transaction to be executed to completion, and without displaying to the user any indication that the payment is being processed by a party other than the merchant; and second code executable by one or more physical computing devices of the payment service to:

host the first code on the payment service at a network location accessible to the client computing device, wherein the merchant web page corresponds to a web document that, when rendered by the client device, instructs the client device to retrieve the code from the network location;

receive, during display of merchant web page at the client device and pursuant to the client device implementing instructions of the web document corresponding to the merchant web page, a request from the client device for the first code; and responsive to the request from the client device, transmit the first code to the client device, wherein the client device is configured to parse the code during display of the merchant web page, and wherein the code, when parsed by the client device:

causes the client device, without being redirected to the web site of the payment service or otherwise navigating away from the merchant web page, to add one or more input elements to the merchant web page enabling the user to input information related to payment for the transaction and submit the information to the payment service, and allows the user to interact with the payment service directly from the merchant web page to cause the transaction to be executed to completion, and without displaying to the user any indication that the payment is being processed by a party other than the merchant.

15. The one or more non-transitory computer-readable media of claim 14, wherein the second code is further executable by the one or more physical computing devices of the payment service to generate the code.

16. The one or more non-transitory computer-readable media of claim 14, wherein the second code is further executable by the one or more physical computing devices of the payment service to populate the one or more input elements with information of the user that is stored at the computing system of the payment service.

17. The one or more non-transitory computer-readable media of claim 14, wherein the second code is further executable by the one or more physical computing devices of the payment service to:

receive the information related to the transaction;

process the information related to the transaction; and transmit to a computing system of the merchant an indication that the information related to the transaction has been processed.

* * * * *